US007810844B2

(12) United States Patent
Dominguez

(10) Patent No.: US 7,810,844 B2
(45) Date of Patent: Oct. 12, 2010

(54) METHOD AND APPARATUS FOR NOTIFICATION OF GUARDIANS OF LOCATION OF LOST PERSONS

(75) Inventor: Randy Alan Dominguez, Oceanside, CA (US)

(73) Assignee: I.C. Protection, Inc., Jupiter, FL (US)

( * ) Notice: Subject to any disclaimer, the term of this patent is extended or adjusted under 35 U.S.C. 154(b) by 1779 days.

(21) Appl. No.: 10/850,711

(22) Filed: May 20, 2004

(65) Prior Publication Data

US 2005/0258635 A1 Nov. 24, 2005

(51) Int. Cl.
*B42D 15/00* (2006.01)

(52) U.S. Cl. ..... 283/70; 283/67

(58) Field of Classification Search ..... 283/67, 283/70, 74, 75; 428/914
See application file for complete search history.

(56) References Cited

U.S. PATENT DOCUMENTS 5,380,046 A * 1/1995 Stephens ..... 283/70
5,912,956 A * 6/1999 Longo et al. ..... 283/74
6,074,721 A 6/2000 Moore et al.
6,231,952 B1 * 5/2001 Lipper ..... 428/914
6,457,585 B1 10/2002 Huffer et al.
2002/0029843 A1 3/2002 Popat et al.
2003/0056410 A1 3/2003 Witkowski
2003/0139219 A1 7/2003 Kurzweil

FOREIGN PATENT DOCUMENTS

FR 2713371 A1 6/1995

* cited by examiner

*Primary Examiner*—Dana Ross
*Assistant Examiner*—Pradeep C Battula
(74) *Attorney, Agent, or Firm*—Donn K. Harms

(57) ABSTRACT

A method and device for identifying a lost person and providing contact information to directly communicate with their guardian. Indicia applied to the skin of a child or other person who might get lost includes the telephone number for directly contacting the guardian. The indicia may also include the name of the person on which it is imparted and directions on contacting a third party if the phone number displayed receives no response. When used with the cellular phone number of the guardian, the indicia can also include instructions to identify the responding guardian using that unique number by matching it to the cellular phone of the responding guardian. The indica may be applied to the skin using a tattoo or other means to impart the indicia temporarily to the skin.

10 Claims, 4 Drawing Sheets

METHOD AND APPARATUS FOR NOTIFICATION OF GUARDIANS OF LOCATION OF LOST PERSONS

BACKGROUND OF THE INVENTION

1. Field of the Invention

The present invention relates to parental or guardian notification of lost children and a means to identify the responding party. More particularly, the device and method herein disclosed relates to a method of providing third parties a manner in which to contact the parents or guardian of a lost child or other individual using a tattoo that may be temporarily applied to the child which may be read by third parties. The tattoo allows third parties to directly contact the parents or guardian of the lost person using only the information which is incorporated into the tattoo and which is visually available to the naked eye. Other information may also be incorporated into the tattoo providing for third party identification of the child to be matched with a database for contact with parents or guardians, or authorized individuals in the case of a lost child being found by a third party.

2. Prior Art

Small children accompanying their parents, older siblings, or other children with a teacher or guardian frequently visit amusement parks, museums, sporting events, and numerous other events where children can accidentally become separated from the person charged with watching them. Frequently, very small children will be unable to converse with anyone finding them due to a lack of developed language skills or fear. Toddlers, even with a reasonable command of the language, frequently are unable to identify their parents or guardian or home in any reasonable fashion that enables third parties to ascertain the child's identity or the parent's or guardian's identity or contact information. Such is the same for older adults or otherwise verbally handicapped individuals. Consequently, a third party finding a lost child or person who cannot reasonably identify themselves or their parents or guardian is left with little option other than calling the police or security at the venue where the child becomes lost.

In years past children have had tags hung on their clothing or around their necks which might provide their identification. However, such tags are easily lost or damaged and do not provide a parent or guardian the security that they will be immediately notified if the child becomes lost.

Other identification systems have been used which place an identification number on a card which might be attached to clothing. A third party reading the card can contact the third party and let them know the child is found and that third party, usually a commercial firm, contacts the parent or guardian. However, such identification cards are easily detached from the child's body or clothing or can become damaged. Further, the need to contact a third party to notify the parent or guardian increases the complication of just reuniting a small and possibly scared child with a parent in the shortest amount of time.

As such, what is needed in the case of small children, or adults or other persons who are verbally or otherwise handicapped from identifying themselves, is a method and device providing that individual with temporary identification that is not easily lost or damaged. Such a temporary identification should not only provide a means to identify the child or person and hence their parent or guardian, it should also provide a means for the person finding the lost child or adult to directly contact the parent or guardian without the need to interface through a business or other third party. A small, scared child generally just wants to hear a parent's voice and get back to that parent as fast as possible. The same is true of a lost older person who generally wants to see a familiar face.

SUMMARY OF THE INVENTION

The method and device herein disclosed provides a means to identify the child which cannot be easily removed or lost by using a temporary tattoo. The term "child" used throughout this application is also intended to include young adults who may be unable to care for themselves due to some physical or mental disability, and/or older adults who are unable to care for themselves in a public situation or travel or walk unsupervised due to illness such as Alzheimer's, or who are simply confused due to advanced age. The disclosed device and method would work well should either a child or an adult become separated from their caregiver.

In addition to information on how to contact the parent directly, the tattoo can also contain the child's name and a cartoon which will help to provide a very willing child for application of the tattoo as well as a child who is very cognizant of its location and its purpose.

Each such tattoo for each individual child can be generated using a conventional PC style computer operatively connected to a printer capable of producing the customized tattoos with the correct indica upon them to provide a party finding the child the ability to call the child by name and to contact their parent or guardian directly without an interface through a service or other third party.

In use in a venue such as an amusement park, the child would be taken to a booth or other location at or near the entrance where the tattoo may be generated based on information provided by the parent or guardian and applied to the child's skin on a temporary basis. The preferred information imparted to each individual tattoo would be specific to the individual child to which the tattoo is to be applied. Also imparted to the tattoo may be a cartoon or fanciful drawing which the child or parent may pick out from a plurality of drawings. In cases where the child picks out the cartoon, it will encourage the child to cooperate and make it a more pleasurable experience.

Preferably the information printed on the tattoo will provide a person who finds the child when lost a direct and immediate way to contact the parent. In the current best mode of the device and method herein, the parent's home telephone, or more preferred, the parent's or guardian's cell phone number, would be one line of indicia impregnated onto the tattoo. Once applied to the child's arm or hand or some other visible part of the body, any person finding the child will have an immediate means for direct contact with the parent.

As noted, direct contact with a parent or guardian is preferred since it provides the quickest means to reunite the child with the parent. Further, since when a child is lost, the parent is generally not too far away, the person finding the child can tell the parent the immediate landmarks adjacent to the child and continually direct the parent approaching on how close they are and if they are going in the right direction. Such direct contact alleviates the need to take the child to a security station or police station where the parent is tracked down using detective work and reunited with the child after a very long time. Instead, using a cell phone number which is tattooed directly onto the child, the finding party can immediately telephone the parent and direct them to the proper location in minutes or less. Further, using the cell phone number of the parent provides an immediate means to identify the parent on his or her arrival. Cell phones are unique to the phone itself and the person carrying it. The person finding the lost child can simply look at the phone number on the cell phone to determine if it is a match to the indica on the tattoo as a means to identify the parent or guardian.

Since very small children are generally shy and have been taught not to talk to or go anywhere with strangers, providing a way to get directly in touch with the parents without trying to interrogate the child also is less traumatic to the child. An additional piece of indicia that can be added to the tattoo is the child's name. In that fashion, a third party, finding a very distraught, crying, or pouting child who has been taught to avoid strangers, will have a means to talk to the child and calm him down using the child's own name. In the instances of parents who might be bringing multiple kids to a venue, it will also provide the person finding the lost child a way to identify the child by name directly to the parent using the cell phone number on the tattoo and the name provided.

The information that is printed upon the individualized tattoos can be done so with the parent and child present on entrance to the venue. In such an application, the parent and child would visit with a venue employee who would take the information from the parent as to the phone number where the parent can be directly contacted by a person finding the child. The parent or child would also provide the child's name, and if desired, pick out the cartoon to accompany the identification and contact information on the tattoo.

The information would be input into a computer having software written for the application. Such software programs generally provide fields on a screen where information is entered. Once all of the necessary information is entered, the computer will be instructed to communicate the proper information to a printer to generate the tattoo specifically individualized for the child on whom it will be applied. The tattoo would then be applied to the skin of the child who for a temporary period will have the parent or guardian's cell phone number and the child's name tattooed on their skin.

Since cell phone numbers are personal to the individual phones and displayable on such phones, the cell phone number can provide an additional function. As noted above, small children are frequently incapable of identifying themselves or their parents. Consequently when a parent shows up to claim the child, it can be hard to determine if the person arriving is in fact the proper parent or authorized guardian. However, by tattooing the individual and unique cell phone number of the parent or guardian on the child upon entering a venue such as an amusement park, a means to identify the parent or guardian to the person finding the child is also provided. If the parent is called to retrieve their child subsequent to the application of the tattoo, the parent can be asked to display the phone number on their cell phone or the finding person can call the cell phone which will then ring and prove that the person showing up to retrieve the child is the person who is supposed to be retrieving the child.

The temporary tattoos could also be generated by computer input from a remote location and either mailed to the parent or delivered to a parent on entry to the venue. In this embodiment of the device and method, the parent or guardian would use a remote computer on a network connected to the computer which generates the tattoo, to enter the cell phone or other phone information, and optionally the child's name, and/or the cartoon character to appear on the final tattoo. In this fashion, the parent could buy a supply of tattoos from a supplier who would mail or otherwise deliver them to the parent at the parent's remote location. This would allow the parent or guardian to buy a long term supply of such tattoos and to have them handy for application to the child to identify both the child and the parent any time the child is going to a venue where they might get lost.

Finally, in another optional embodiment of the disclosed device and method, the computer which generates the tattoo could also have a database in which the child and parent information is stored. In this embodiment, as a back up to the parent not being contacted directly, the child and parent's name address and contact information could be stored. In this fashion, if somehow the child becomes lost at a large amusement park or sports venue, or because the parent is incapacitated, or because of some sort of disaster, security personnel would be able to escort the child to a save station where the child's vital contact information could be identified based on the cell phone number on their arm. Security could then call an alternate party to rescue the child if they cannot contact the parent on the cell phone number.

Consequently, by generating an individualized tattoo for placement on the skin of specific children, a means to directly contact the parent is provided. Further provided is a means to speak to the child by name, and a means to identify the parent or guardian who shows up to claim the child based on being telephoned using the number on the child's tattoo. Further, a means to identify alternate emergency contacts is provided if such a database is kept, for instances where the parent or guardian is separated from the child due to the parent or guardian becoming incapacitated or during a disaster or emergency.

With respect to the above description, before explaining at least one preferred embodiment of the invention in detail, it is to be understood that the invention is not limited in its application to the details of construction and to the arrangement of the components or steps set forth in the following description or illustrated in the drawings, nor just to children. The apparatus and methods of the invention are capable of other embodiments and of being practiced and carried out in various ways which will be obvious to those skilled in the art. Also, it is to be understood that the phraseology and terminology employed herein are for the purpose of description and should not be regarded as limiting.

As such, those skilled in the art will appreciate that the conception, upon which this disclosure is based, may readily be utilized as a basis for designing of other structures, methods and systems for carrying out the several purposes of the present disclosed device and method. It is important, therefore, that the claims be regarded as including such equivalent construction and methodology insofar as they do not depart from the spirit and scope of the present invention.

An object of this invention is to provide a method of individual identification of a child which may be applied to the skin temporarily using a tattoo.

Another object of this invention is the provision of a method to provide for immediate direct contact with a parent or guardian of a lost child without the need for an interface through any third party.

A further object of this invention is the provision of a means for a third party finding a lost child to determine the child's name and a manner to directly contact the child's parent or guardian without communicating with the child in any fashion.

An additional object of this invention is the provision of a means to identify the contacted parent or lost child's identity and authorization for retrieving the lost child through the use of the cell phone called and possessed by the parent or guardian.

Yet an additional object of this invention is the provision of a method for third parties to contact a parent a prior designated alternate parent or guardian in case the primary parent becomes incapacitated or out of touch with their cell phone.

Further objects of the invention will be brought out in the following part of the specification, wherein detailed description is for the purpose of fully disclosing the invention without placing limitations thereon.

BRIEF DESCRIPTION OF DRAWING FIGURES

DETAILED DESCRIPTION OF THE PREFERRED EMBODIMENTS OF THE INVENTION

Figure 1:
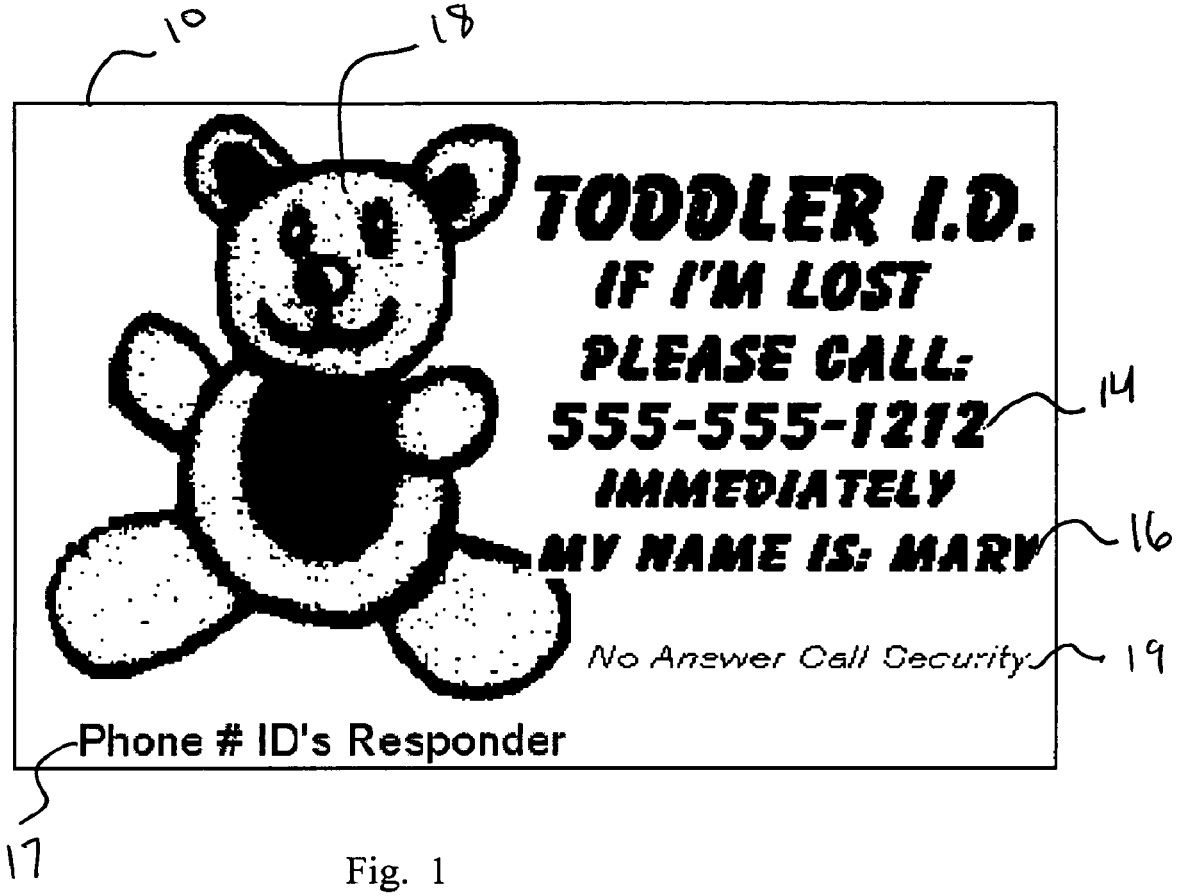
FIG. 1 is a top view of the tattoo generated for application to the child's skin to alert finding persons to the child's guardian cell phone number.

Referring now to the drawings, FIGS. 1-4 depict the various embodiments and employment methods of the herein disclosed device and method, as shown in FIG. 1, the label or tag 10 bearing a tattoo 12 provide a means to individually identify the child or adult on whom it is affixed as well as a means to identify a responding parent or guardian to the finding party. The indica on the label 10 includes a phone number 14, which would preferably be the parent's or guardian's or caregiver's cell phone number 14 which would be printed with the other indicia using ink or dye which transfers when wet or by forming the indicia in a manner where it is temporarily transferable to the skin such as press type with adhesive.

Also, optionally directions that the phone number provides a means to identify the responder 17 and directions providing a means for alternate response 19 such as taking the person to security, if the phone number 14 does not work, may be included in the indica on the tag 10. The indicia is printed either on the label or tag 10 formed of tissue-like paper or on porous plastic type paper or other water permeable means for retaining the indicia, which once water is applied and wetted, will allow the transfer of the ink or dye to the skin. Those skilled in the art will realize that other means to generate indica and temporarily adhere it to the skin may be used and all are considered included in the scope of this patent. However the current preferred mode employs a tattoo for ease of application and generation of the indica to the skin.

The indica forming the tattoo 12 on the tag 10, in addition to phone number 14 information on how to best contact the parent or guardian, can also include the child's name 16, and optionally a cartoon 18 which can be chosen by the child if desired.

Every individualized tattoo 12, is easily generated employing a conventional PC style computer operatively connected to an inkjet printer using conventionally available inks or dyes capable of producing the transferable indica on the customized tattoos 12 on the tags. The indica transferred to the skin when the tag 10 is wetted, thereafter provides anyone finding the child or adult, the ability to call them by name, and to contact their parent or guardian directly without being routed through security or another third party, and to identify the responding parent by inspecting the cell phone number on the respondent's cell phone if that is the phone number 14 imprinted.

In use as a means to identify the child and parent if separated in a venue such as an amusement park, a method can be followed during the entry process to generate the tattoo identification and put the system in motion. In a first step 20, during entry, the child or adult needing the tattoo identification can be taken to the tattoo generating station located near the entrance. Once there, the parent will be asked to provide one or a combination of the parent's phone number 14, the child's name 16, and a specific cartoon FIG. 18 the child would like. In the simplest mode of the device, the child's or wearer's name would be input 22. A tattoo would then be generated 24 which in the current preferred mode uses a precut tag 10 the indica provide, once input into appropriate software in the computing device, the provided information would be printed for transfer to the child's skin. However those skilled in the art will no doubt realize that other manner of generating a temporary tattoo with the desired indicia thereon can be used and such are anticipated.

Figure 2:
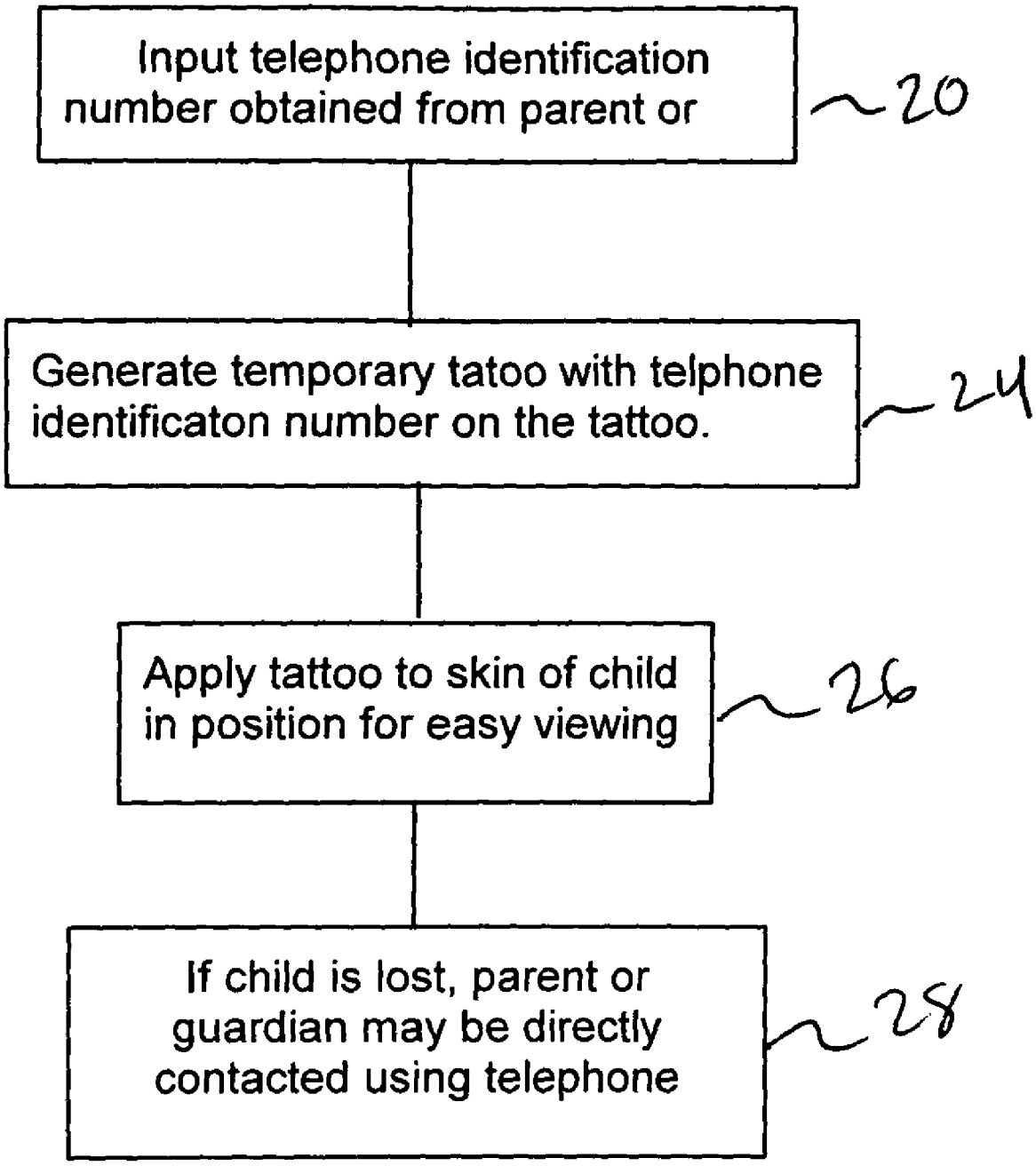
FIG. 2 shows a flow chart of one preferred embodiment of the method where the tattoo is generated and applied to the child's skin.
Figure 3:
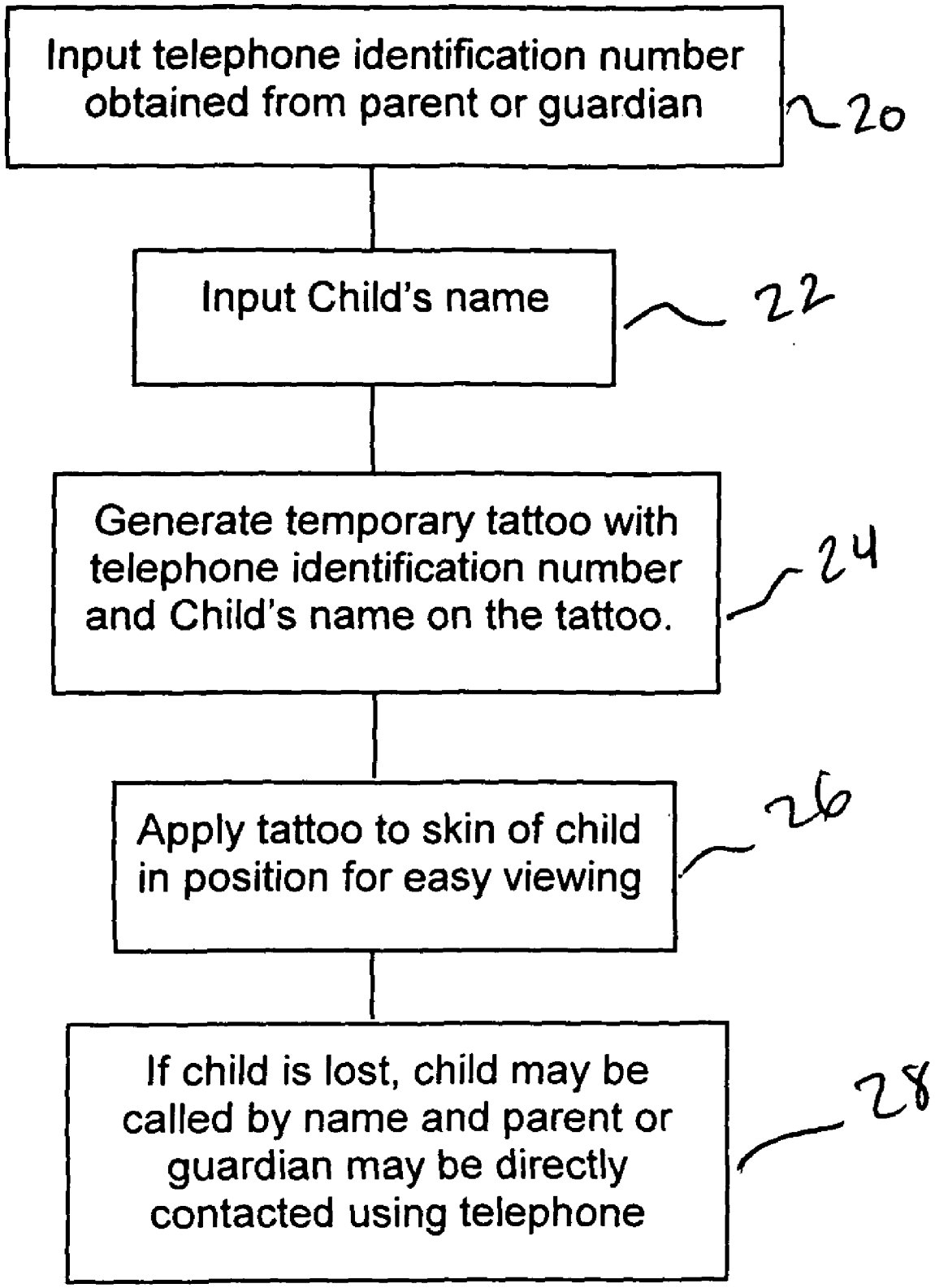
FIG. 3 depicts a flow chart which includes placing the child's name on the temporary tattoo.
Figure 4:
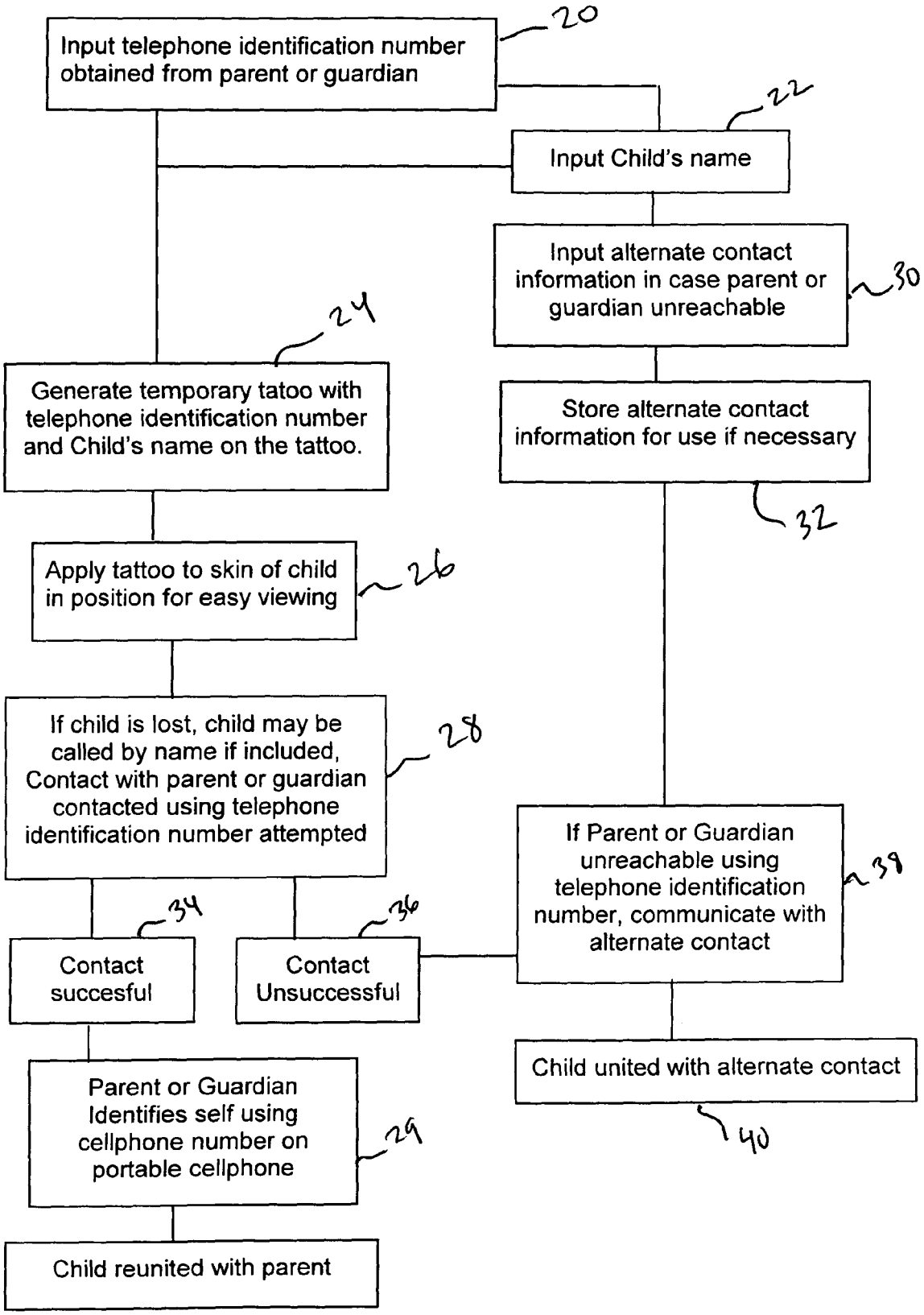
FIG. 4 is a flow chart showing optional steps where the child's name may be added, alternate contacts stored, and the use of the called cell phone to identify the responding individual.

Once generated with the desired indicia the tattoo is applied to the skin of the wearer 26. This is done currently using water or another means for wet transfer, where the tag 10 is moistened and the tattoo applied to the skin of the child or other person who is to be temporarily identified. As noted, in the current best mode of the device, the phone number 14 in the form of a portable cell phone and the wearer's name 16 would best be imparted. If the child is lost, the finding party views the tattoo and can directly contact the parent or guardian 28 using the phone telephone number 14 and thereafter used the phone number as a means to identify the responding parent or guardian on arrival. If added to the indicia as in FIG. 3, the name of the wearer of the tattoo provides the finding party a means to identify the name of the child and converse with him or her and identify the individual child to a responding parent. However, the tattoo indicia without the name being added as shown in FIG. 2 could be employed if the name is not desired. Employing the name would be most useful in cases where a parent or guardian might have multiple children in the same venue at the same time especially if the children are traveling in a group without the adult.

If the wearer of the tattoo becomes lost, the finding party can talk with the child by name and call the parent or guardian directly. Once the responding parent arrives, should he or she be challenged by the finding party as to their identity, they need only display their cell phone number to the finding party to identify themselves as the proper parent or guardian.

In a similar method of operation of the apparatus and device, the temporary tattoos could also be generated by computer input from a remote location. They would then be delivered to the parent or guardian prior to entry to a venue, or for everyday use in a plurality of different venues. This embodiment would facilitate the provision of the temporary decals by allowing input 20 over the internet, or in a self service mode at a venue using an ATM style machine that can print the tattoo.

In this embodiment of the device and method, the parent or guardian would use a remote computer or ATM connected to a computer network which would communicate input information to a computer and printer to generate the tattoos on the tags 10. The parent or guardian would input one or a combination of a telephone number 14, the child's name 16, and a preferred design or cartoon 18. The minimum input of course would be the telephone number 14. The tags 10 with the tattoo generated upon them would then be mailed or otherwise delivered to the parent or guardian and applied and used as noted above.

In a third embodiment of the method of employing the tattoo, the computer to which the information input from the parent and which generates the tattoos, can also store the input information in a database. This embodiment would use the same steps as FIG. 2 and FIG. 3, but would add additional steps for input as a back up, if the parent not being contacted directly, the child and parent's name address and contact information could be input 30 stored 32. If the child is lost and the parent can be contacted directly 34, the system works the same as above in that contact with the parent is handled by use of the telephone number 28 and the responding parent or guardian can identify themselves 29 when they find the child.

However, if the parent or guardian cannot be contacted, the child would be taken to the appropriate security which would be able to identify the child by the telephone number 14 on the tattoo. Security could then call the alternate party 38 input at origin but not added to the indicia of the tattoo, to rescue the child if they cannot contact the parent on the telephone number 14, thereby providing a means to identify alternate emergency contact in instances where the parent or guardian is separated from the child and unreachable. The child or person wearing the tattoo would then be united with that alternate contact 40.

While all of the fundamental characteristics and features of the present method and apparatus of the disclosed invention have been described herein, with reference to particular embodiments thereof, a latitude of modification, various changes and substitutions are intended in the foregoing disclosure and it will be apparent that in some instance, some features of the invention will be employed without a corresponding use of other features without departing from the scope of the invention as set forth. It should be understood that any such substitutions, modifications, and variations may be made by those skilled in the art without departing from the spirit or scope of the invention. Consequently, all such modifications and variations are included within the scope of the invention as defined by the following claims.

What is claimed is:

1. A method for identifying a lost person and providing contact information to directly communicate with their guardian comprising the steps of:

collecting a cellular telephone number from said guardian;

imparting indicia upon the skin of a second person for whom said guardian is responsible;

including in said indicia, said cellular telephone number and directions to contact said guardian using said telephone number; and including in said indicia, instructions to identify said guardian by matching said cellular telephone number included in said indicia to a displayed number on said guardian's cellular phone.

2. The method for identifying a lost person and providing contact information of claim 1 wherein said indicia is imparted upon said skin of said second person using a tattoo.

3. The method for identifying a lost person and providing contact information of claim 2, comprising the additional step of:

employing a data processing means to collect said telephone number; and employing a printer, communicating with said data processing means to generate said tattoo.

4. The method for identifying a lost person and providing contact information of claim 1 wherein said indicia is imparted upon said skin of said second person using a tattoo.

5. The method for identifying a lost person and providing contact information of claim 1, comprising the additional step of:

storing alternate guardian information with a contact agent, said alternate guardian information matched to said telephone number; and including instructions in said indicia to take said person to said contact agent should said guardian not be reached directly by calling said telephone number;

said contact agent identifying said guardian and said alternate guardian using said telephone number; and said contact agent thereafter contacting one of said guardian or said alternate guardian and uniting said person therewith; and identifying said guardian, should said guardian respond, by matching said telephone number included in said indicia to a displayed number on said guardian's cellular phone.

6. A method for identifying a lost person and providing contact information to directly communicate with their guardian comprising the steps of:

collecting a cellular telephone number from said guardian;

imparting indicia upon the skin of a second person for whom said guardian is responsible;

including in said indicia, said cellular telephone number and directions to contact said guardian using said cellular telephone number;

including in said indicia, the name of said second person; and including in aid indicia, instructions to identify said guardian by matching said telephone number in said indicia to a displayed number on said guardian's cellular phone.

7. The method for identifying a lost person and providing contact information of claim 2 wherein said indicia is imparted upon said skin of said second person using a tattoo.

8. The method for identifying a lost person and providing contact information of claim 7, comprising the additional step of:

employing a data processing means to collect said telephone number; and employing a printer, communicating with said data processing means to generate said tattoo.

9. The method for identifying a lost person and providing contact information of claim 6 wherein said indicia is imparted upon said skin of said second person using a tattoo.

10. The method for identifying a lost person and providing contact information of claim 6, comprising the additional step of:

storing alternate guardian information with a contact agent, said alternate guardian information matched to said telephone number; and including instructions in said indicia to take said person to said contact agent should said guardian not be reached directly by calling said telephone number;

said contact agent identifying said guardian and said alternate guardian using said telephone number; and said contact agent thereafter contacting one of said guardian or said alternate guardian and uniting said person therewith; and identifying said guardian, should said guardian respond, by matching said telephone number included in said indicia to a displayed number on said guardian's cellular phone.

* * * * *